US006135833A

United States Patent [19]

Tsunoda

[11] Patent Number: 6,135,833

[45] Date of Patent: Oct. 24, 2000

[54] ENGINE COOLING SYSTEM FOR OUTBOARD ENGINE

[75] Inventor: Masaki Tsunoda, Wako, Japan

[73] Assignee: Honda Giken Kogyo Kabushiki Kaisha, Tokyo, Japan

[21] Appl. No.: 08/992,382

[22] Filed: Dec. 17, 1997

[30] Foreign Application Priority Data

Dec. 19, 1996 [JP] Japan ..... 8-340178
Oct. 2, 1997 [JP] Japan ..... 9-270232

[51] Int. Cl.[7] ..... B63H 21/38
[52] U.S. Cl. ..... 440/88; 123/41.08
[58] Field of Search ..... 440/88; 123/41.08

[56] References Cited

U.S. PATENT DOCUMENTS

| | | | |
|---|---|---|---|
| 3,431,882 | 3/1969 | Irgens | 440/88 |
| 3,918,418 | 11/1975 | Horn | 123/41.08 |
| 4,312,304 | 1/1982 | Tyner | 123/41.74 |
| 4,588,385 | 5/1986 | Suzuki et al. | 440/88 |
| 5,715,777 | 2/1998 | Wada et al. | 440/88 |
| 5,769,038 | 6/1998 | Takahashi et al. | 123/41.82 R |
| 5,904,605 | 5/1999 | Kawasaki et al. | 440/88 |
| 5,970,926 | 10/1999 | Tsunoda et al. | 123/41.29 |

FOREIGN PATENT DOCUMENTS 8-100671 4/1996 Japan .

*Primary Examiner*—Sherman Basinger
*Attorney, Agent, or Firm*—Merchant & Gould P.C.

[57] ABSTRACT

An engine cooling system for an outboard motor includes a thermostat mounted on an upper surface of a cylinder block to open and close a cooling water passage depending on the temperature of cooling water inside the cooling water passage, and a relief valve mounted on an upper portion of a side wall of the cylinder block and located adjacent to the thermostat to open and close the cooling water passage depending on the pressure of cooling water inside the cooling water passage. Since the relief valve is located adjacent to the thermostat, the distance (length of an isolated portion of a drainage passage extending) between the thermostat and the relief valve is very small. In the case where the isolated drainage passage portion has no cooling water flowing therethrough, the pressure of the cooling water inside the cooling water passage rises until the relief valve is open. When the relief valve is open, the cooling water flows into the drainage passage with the result that a sufficient cooling effect can be attained over the entire area of the cooling water passage including the isolated drainage passage portion.

8 Claims, 10 Drawing Sheets

ENGINE COOLING SYSTEM FOR OUTBOARD ENGINE

BACKGROUND OF THE INVENTION

1. Field of the Invention

The present invention relates generally to an engine cooling system for outboard motors, and more particularly to such an engine cooling system which is equipped with a thermostat operable to open and close a cooling water passage depending on the temperature of cooling water inside the cooling water passage, and a relief valve operable to open and close the cooling water passage depending on the pressure of cooling water inside the cooling water passage.

2. Description of the Prior Art

A conventional engine cooling system for outboard motors is disclosed, for example, in Japanese Patent Laid-open Publication No. 8-100671.

The disclosed engine cooling system includes a cooling water supply passage and a cooling water return passage (drainage passage) that are formed by two juxtaposed recessed portions extending longitudinally in a vertically extending lateral projection on one side of a cylinder block, and a cover attached to the projection to close the recessed portions so as to define a water jacket including the cooling water supply and drainage passages. The cooling water drainage passage extends along a mating surface between the cylinder block and a cylinder head.

The cover has a vertically elongated configuration and is provided with a thermostat which opens and closes a cooling water passage depending on the temperature of cooling water inside the cooling water passage. The cover is also equipped with a relief valve which opens and closes the cooling water passage depending on the pressure of cooling water inside the cooling water passage. The thermostat and the relief valve are vertically spaced far from each other.

The engine cooling system of the foregoing construction operates such that when the pressure in the cooling water supply passage is higher than a predetermined pressure, the relief valve is open, allowing the cooling water to flow into the cooling water drainage passage; and when the cooling water temperature exceeds a predetermined temperature (thermostatopening temperature), the thermostat is caused to open, allowing the cooling water to flow into the cooling water drainage passage.

The conventional engine cooling system, however, has a drawback that when the cooling water temperature is below the predetermined thermostat-opening temperature, the cooling water does not flow through a portion of the cooling water drainage passage extending between the position of the thermostat and the position of the relief valve spaced from the thermostat position, regardless of whether or not the relief valve is open. If this condition continues, the engine wall develops a temperature difference between two remotely spaced portions of the cylinder block due to lack of cooling water in the drainage passage portion. This temperature difference makes it difficult to maintain a uniform temperature distribution over an area extending along the mating surface between the cylinder block and the cylinder head.

SUMMARY OF THE INVENTION

With the foregoing drawback in view, it is an object of the present invention to provide an engine cooling system for an outboard motor, which is capable of maintaining a uniform temperature distribution over the entire area of a portion of the engine extending along a mating surface between a cylinder block and a cylinder head even when engine operation continues with the cooling water temperature kept below a predetermined thermostat-opening temperature.

An engine cooling system of an outboard motor includes a thermostat disposed across a cooling water passage in an engine to open and close the cooling water passage depending on the temperature of cooling water inside the cooling water passage, and a relief valve disposed across the cooling water passage to open and close the cooling water passage depending on the pressure of cooling water inside the cooling water passage. The thermostat is mounted on an upper surface of a cylinder block of the engine, and the relief valve is mounted on an upper portion of a side wall of the cylinder block and located adjacent to the thermostat.

With this arrangement, since the relief valve is disposed in a position adjacent to the thermostat, the distance (length of an isolated portion of a drainage passage extending) between the thermostat and the relief valve is very small. In the case where the isolated drainage passage portion has no cooling water flowing therethrough, the cooling water pressure inside the cooling water passage rises until the relief valve is open. When the relief valve is open, the cooling water flows into the drainage passage with the result that a sufficient cooling effect can be attained throughout the entire area of the cooling water passage including the isolated drainage passage portion. The drainage passage is kept at a uniform temperature throughout the length thereof, and so a portion of the engine extending along the mating surface between the cylinder block and a cylinder head has a uniform temperature distribution.

The above and other object, features and advantages of the present invention will become manifest to those versed in the art upon making reference to the detailed description and accompanying sheets of drawings in which preferred structural embodiments incorporating the principles of the present invention are shown by way of illustrative examples.

DETAILED DESCRIPTION OF THE INVENTION

Certain preferred structural embodiments of the present invention will be described below in greater detail with reference to the accompanying sheets of drawings.

Figure 1:
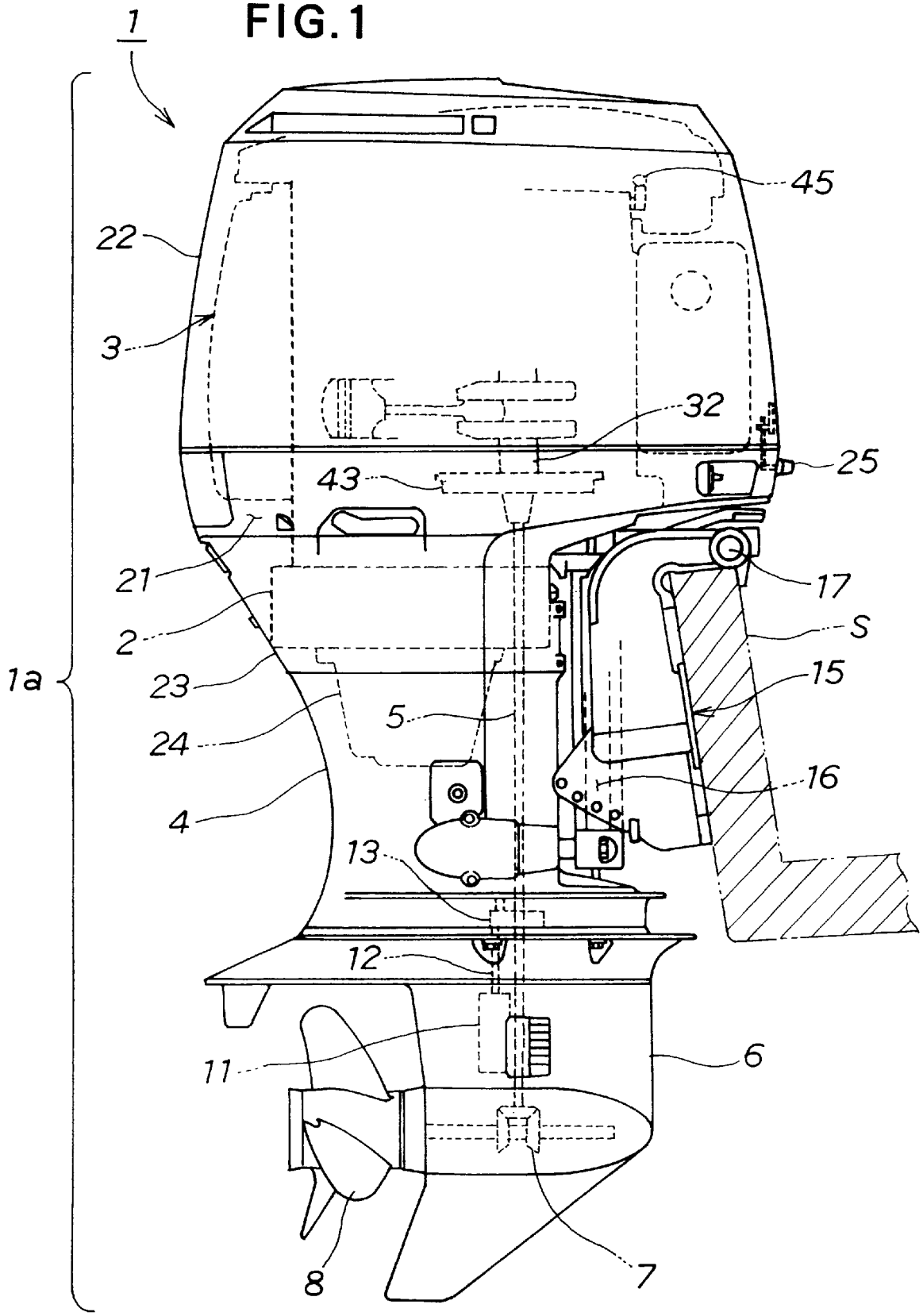
FIG. 1 is a side view of an outboard motor attached to the stern of a hull.

As shown in FIG. 1, an outboard engine or motor 1 includes an outboard motor body 1*a* and an outboard motor attachment mechanism 15 for attaching the outboard motor body 1*a* to the stern of a hull S.

The outboard motor body 1*a* is equipped with a vertical multicylinder engine 3 mounted on an engine mount case (engine support case) 2. An extension case 4 is disposed below the engine mount case 2 and defines therein an exhaust expansion chamber. A vertical shaft 5 extends vertically through an internal space of the extension case 4 for transmitting the power of the engine 3 to a propeller 8.

A gear case 6 is connected to a lower end of the extension case 4 and houses therein a dog clutch which is associated with a bevel gear set 7 for switching or changing over the forward and backward movements of the hull S. The bevel gear set 7 has an output shaft to which the propeller 8 is firmly connected so that the propeller 8 is rotatably driven by the engine power transmitted via the vertical drive shaft 5. The gear case 6 also houses a cooling water screen 11 which is connected by a cooling water supply pipe 12 to a water pump 13 disposed in the internal space of the extension case 4.

The outboard motor attachment mechanism 15 is a fixture assembly used for securing the outboard motor body 1*a* to the stern of the hull S. The attachment mechanism 15 supports the motor body 1*a* such that the motor body 1*a* can swing in the lateral direction about a vertical swivel shaft 16 and it also able to tilt up and down about a horizontal tilt shaft 17.

The engine 3 is covered jointly by an under case 21 and an engine cover 22. The under case 21 and the engine cover 22 are detachably connected together by a lock mechanism 25. The under case 21 has a lower end held in contact with an upper end of an under cover 23 which is provided to cover the mount case 2. The under cover 23 has the function of a decorative or ornamental cover. An oil pan 24 is connected to a lower end of the mount case 2.

Figure 2:
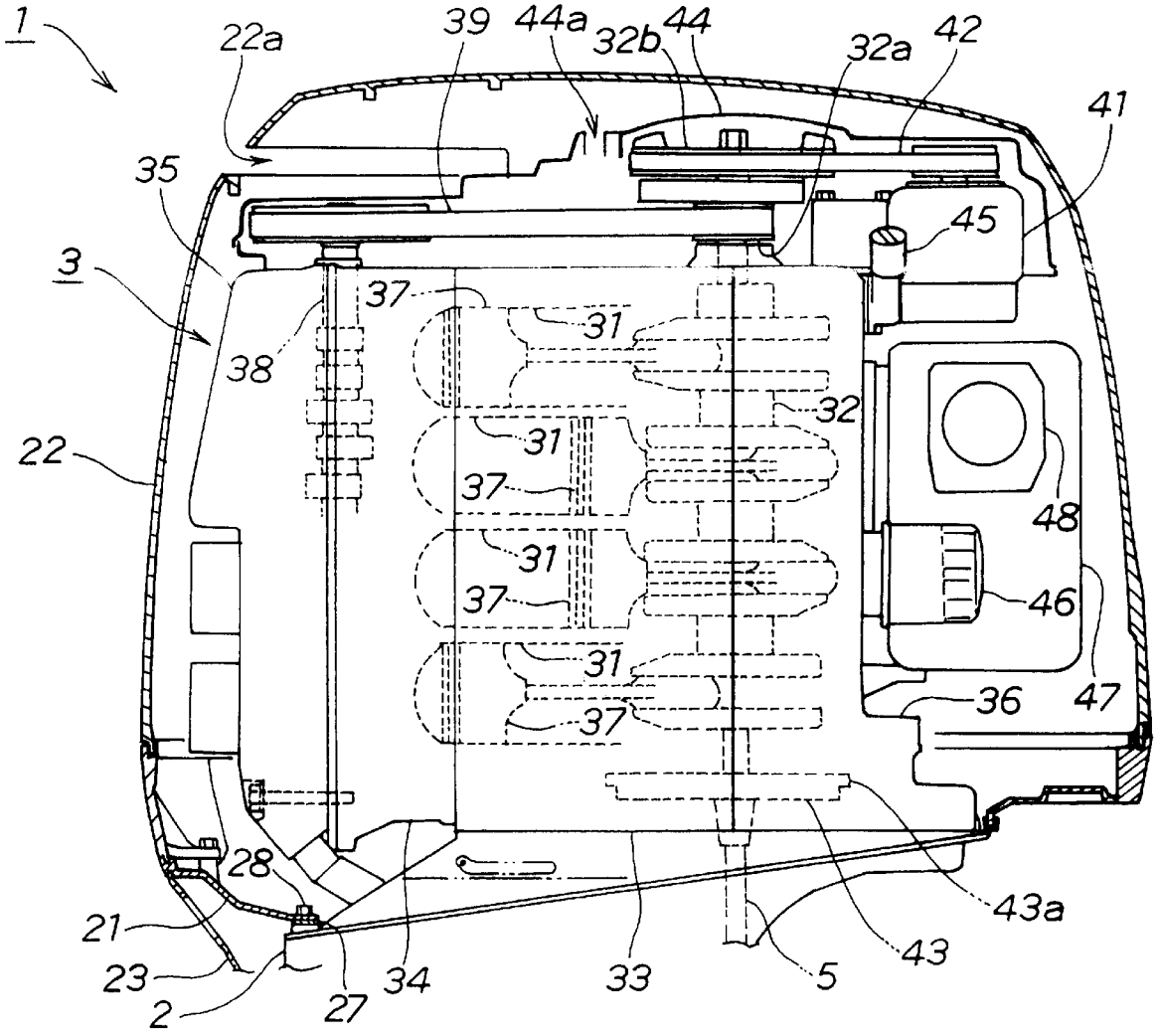
FIG. 2 is a side view of a vertical multicylinder engine of the outboard motor with a cover shown in cross section.

As shown in FIG. 2, the vertical multicylinder engine 3 is a multicylinder four-stroke water-cooled engine with four vertically arranged cylinders 31 disposed horizontally and a crankshaft 32 disposed vertically. With the engine thus arranged, a cylinder block 33 and a cylinder head 34 have respective contact surfaces lying substantially vertically, and the cylinder head 34 and a head cover 35 have respective contact surfaces (i.e., a mating surface) lying in a substantially vertical plane.

The engine 3 is disposed vertically with its cylinder head 34 and head cover 35 located at the rear side (left-hand side of FIG. 1) of the outboard motor 1. In FIG. 2 designated by 36 is a crankcase bolted to the cylinder block 33, and numeral 37 denotes a piston slidable in each the cylinders 31.

Figure 4:
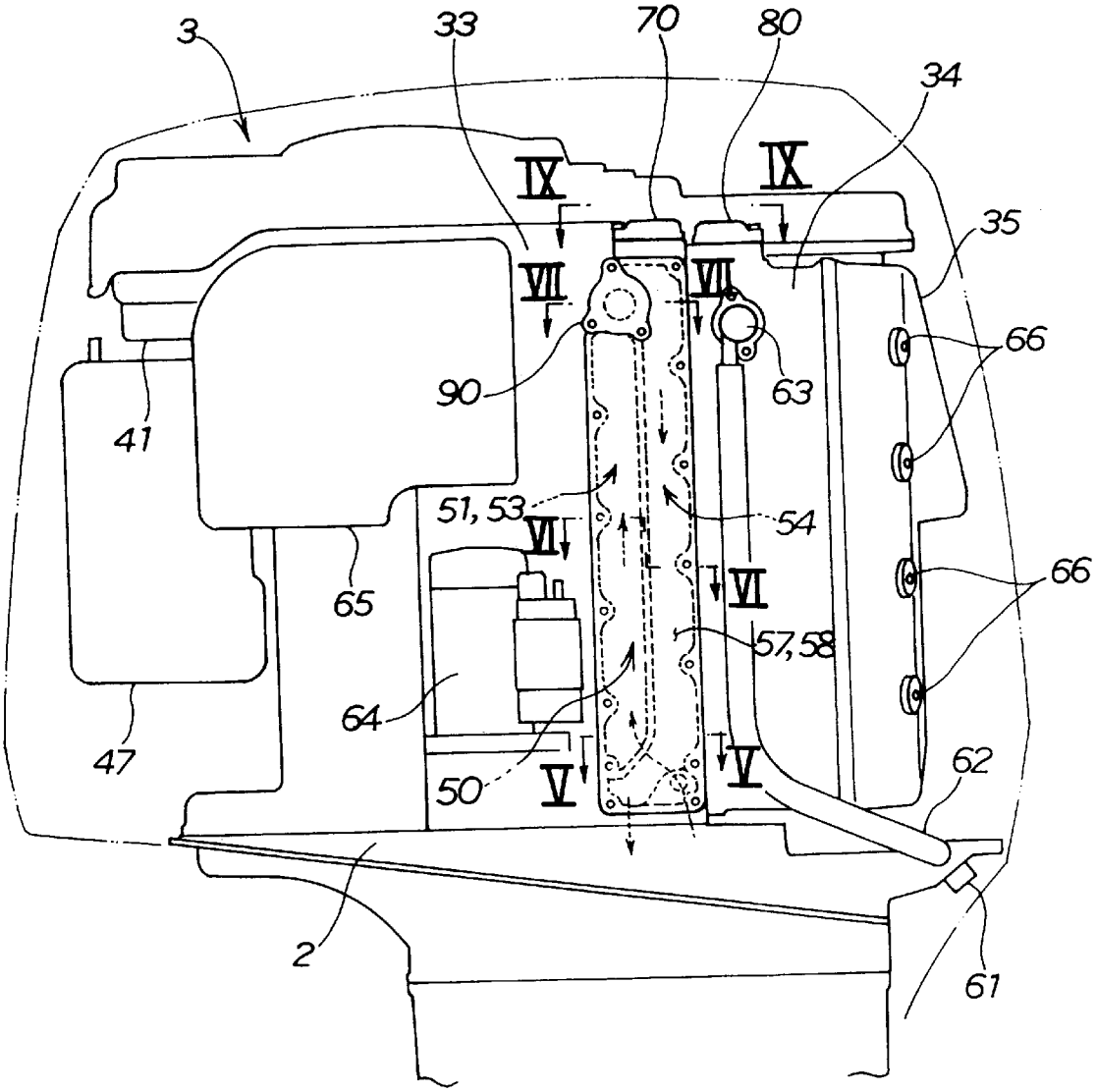
FIG. 4 is a side view of the engine of FIG. 2 from the opposite side, showing the cooling water passage of the present invention.

The crankshaft 32 has an upper end to which a first pulley 32*a* and a second pulley 32*b* are connected one behind the other. The crankshaft 32 drives a camshaft 38 via a first endless belt 42 trained around the first pulley 32*a* and a crankshaft pulley (not designated). The crankshaft 32 also drives an alternator 41 via a second endless belt 42 trained around the second pulley 32*b* and an alternator pulley (not designated). The first and second endless belts 39, 42 are covered by a belt cover 44. The belt cover 44 has formed therein a ventilating hole or opening 44*a* through which air inside the belt cover 44 is driven out to the outside of the engine cover 22. The engine cover 22 has an air intake hole 44*a* formed at an upper portion thereof. The crankshaft 32 has a lower end to which a flywheel 43 with toothed ring 43*a* is attached for engagement with a pinion gear (not shown) on a starter motor 64 (FIG. 4).

An oil filler hole 45 is provided in an inclined condition at a front surface of the crankcase 36. Reference character 46 denotes an oil filter; 47, an intake silencer defining therein a silencer chamber; and 48, a throttle valve device.

The under case 21 is bolted to the mount case 2 with a rubber vibration isolator 27 disposed therebetween.

Figure 3:
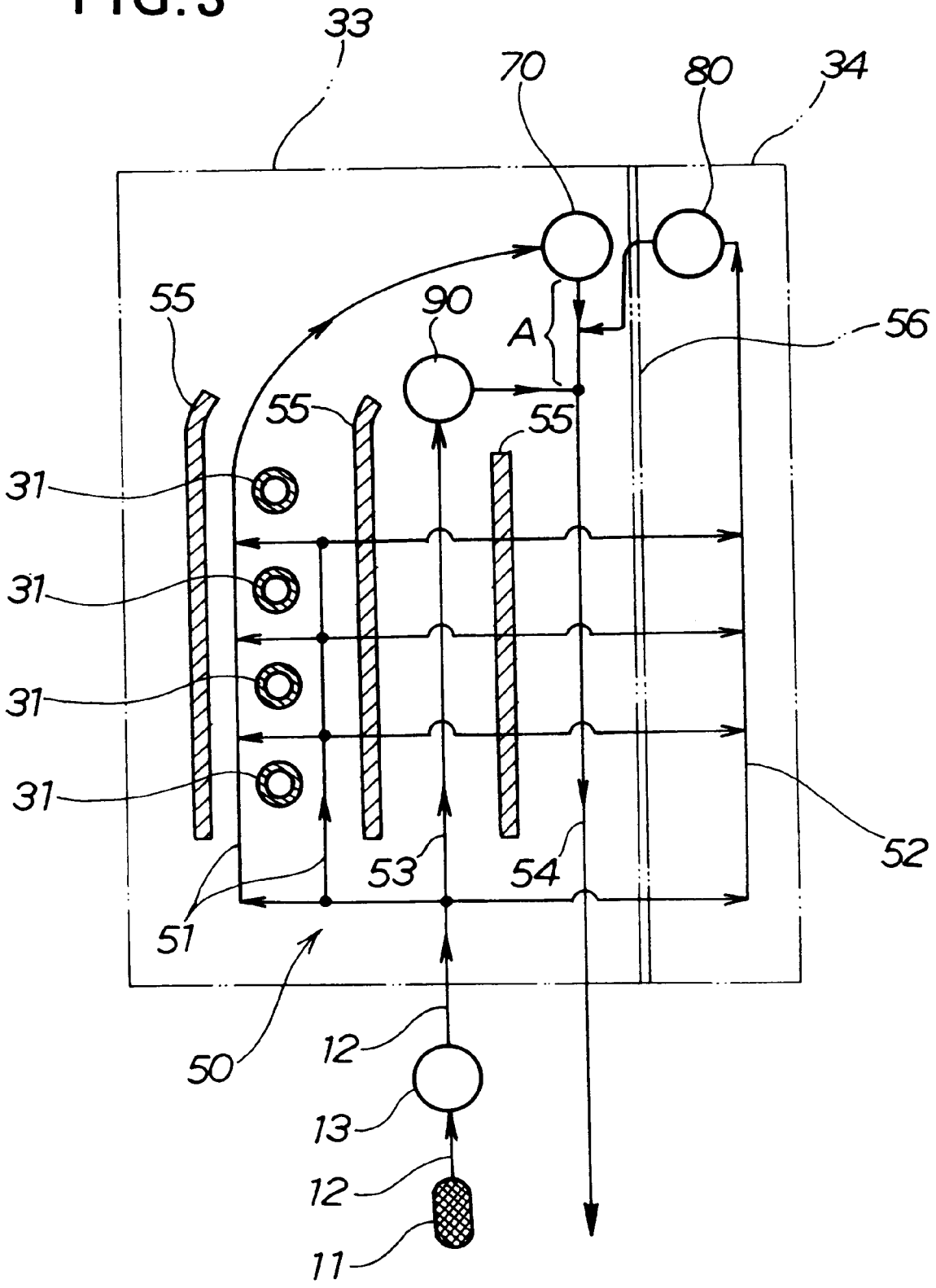
FIG. 3 is a diagrammatical view showing a cooling water passage of the engine according to the present invention.

FIG. 3 diagrammatically shows a cooling water passage in the vertical multicylinder engine 3 according to the present invention, the cooling water passage being formed by the water jacket.

The engine 3 has a cooling water passage 50 connected to the cooling water supply pipe 12. The cooling water passage 50 is composed of a first cooling passage 51 formed by the water jacket in the cylinder block 33, a second cooling passage 52 formed by the water jacket in the cylinder head 34, a bypass passage 53, and a drainage passage 54. The drainage passage 54 is a passage which is provided to draw off the cooling water to the outside of the engine 3 after the cooling water has passed the first and second cooling passages 51, 52.

The first cooling passage 51 communicates with the drainage passage 54 via a first thermostat 70. The second cooling passage 52 communicates with the drainage passage 54 via a second thermostat 80. The bypass passage 53 communicates with the drainage passage 54 via a relief valve 90. The first and second thermostats 70, 80 are temperature-controlled valves each of which operates to open and close the cooling water passage 50 depending on the cooling water temperature inside the cooling water passage 50. The relief valve 90 is a pressure-operated valve which operates to open and close the cooling water passage 50 depending on the cooling water pressure inside the cooling water passage 50. The cooling water passage 50, the first and second thermostats 70, 80 and the relief valve 90 jointly constitute an engine cooling system of the present invention.

In FIG. 3, reference character 55 designates a plurality of walls provided in the cylinder block 33 to define a part of the cooling water passage 50; and 56, a gasket disposed between respective contact surfaces of the cylinder block 33 and the cylinder head 34 to provide a hermetic seal between the cylinder block 33 and the cylinder head 34.

FIG. 4 is a side view of the vertical multicylinder engine 3 of FIG. 3 from the opposite side.

As shown in FIG. 4, the first thermostat 70, which is incorporated in the cooling water passage 50 of the engine 3 together with the second thermostat 80 and the relief valve 90, is disposed on an upper surface of the cylinder block 33. The relief valve 90 is disposed adjacent to the first thermostat 70 and located on an upper part of one side surface of the cylinder block 33. The second thermostat 80 is disposed on an upper surface of the cylinder head 34.

Since the first and second thermostats 70, 80 are disposed on the upper surface of the cylinder block 33 and the upper surface of the cylinder head 34, respectively, the relief valve 90 can be mounted on the upper part of the side surface of the cylinder block 33.

More particularly, a part of the first cooling passage 51, the bypass passage 53 and the drainage passage 54 are disposed on the same side (front side of the sheet of FIG. 4) of the cylinder block 33. This part of the first cooling passage 51, the bypass passage 53 and the drainage passage 54 are vertically elongated and they are covered by a housing 57 and a cover 58, as detailed later with reference to FIG. 5.

In order to enable the cooling water passage 50 to be cleaned or washed with washing water, the engine 3 further includes a washing water inlet 61, a hose 62, and a check valve 63. The check valve 63 is mounted on the cylinder head 63. In FIG. 4, reference character 64 denotes the starter motor described above; 65, an electric equipment box; and 66, ignition plugs.

Figure 5:
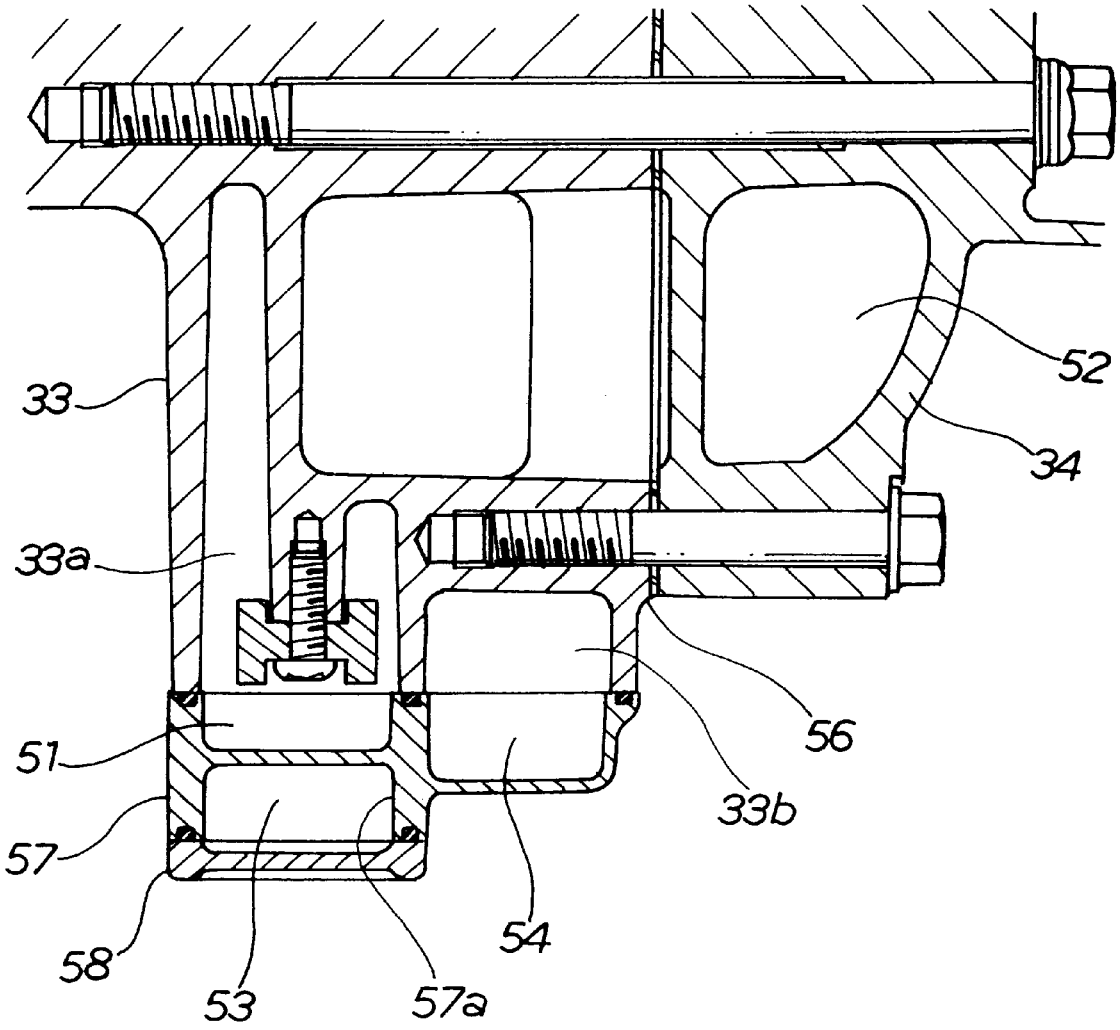
FIG. 5 is an enlarged cross-sectional view taken along the line V—V of FIG. 4.

FIG. 5 is an enlarged cross-sectional view taken along the line V—V of FIG. 4. As shown in this figure, the cylinder block 33 has two vertically elongated recessed portions 33*a*, 33*b* formed in lateral juxtaposition in the side surface of the cylinder block 33. Respective front sides (open sides) of the recessed portions 33*a*, 33*b* are closed by the housing 57. The above-mentioned part of the first cooling passage 51 is defined jointly by the recessed portion 33*a* and the housing 57. The drainage passage 54 is defined jointly by the recessed portion 33*b* and the housing 57. The housing 57 has a vertically elongated recessed portion 57*a* formed in a left side portion of the front surface of the housing 57. The front side (open side) of the recessed portion 57*a* is closed by the cover 58. The cover 58 and the recessed portion 57*a* jointly define the bypass passage 53.

Figure 6:
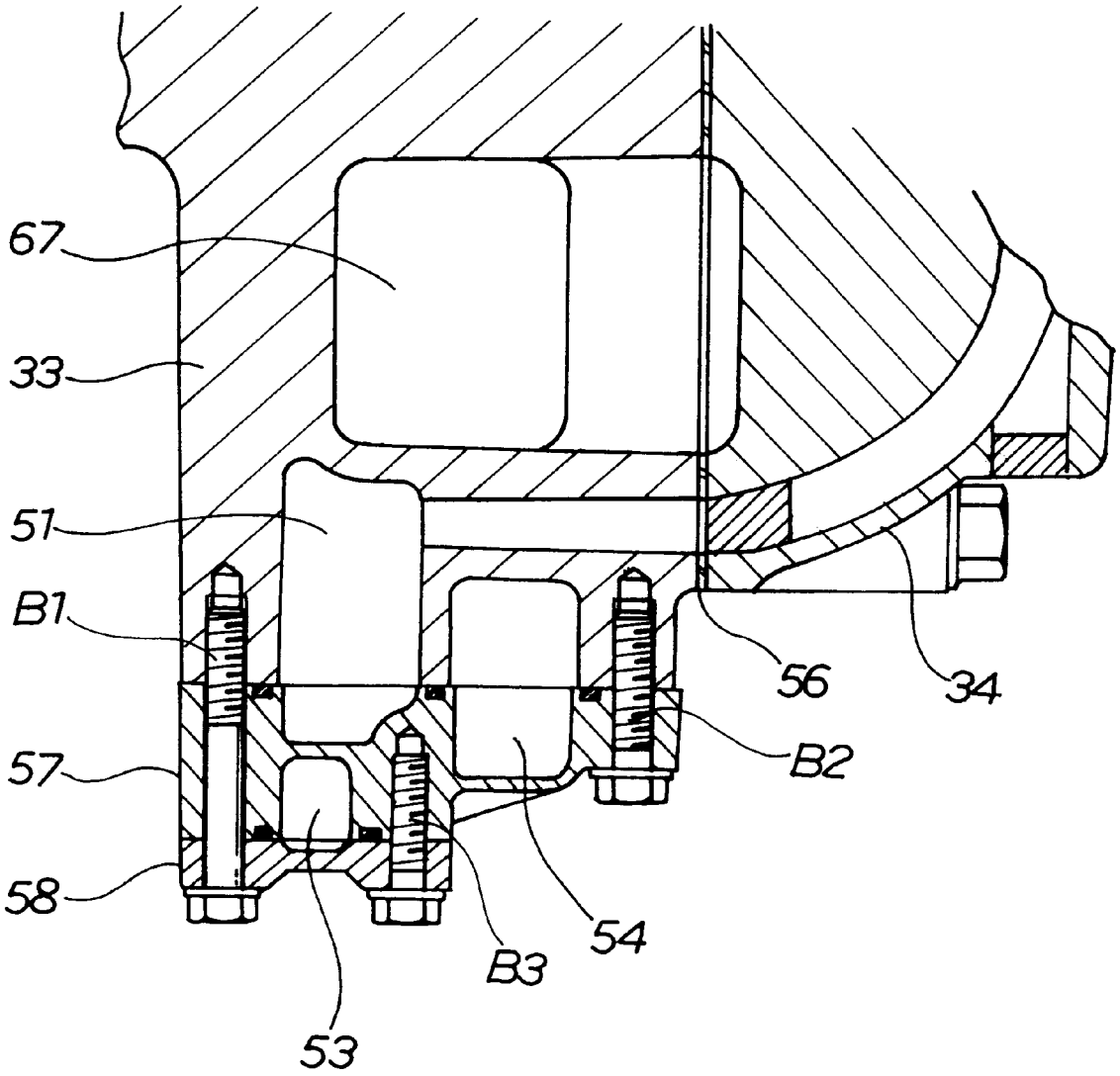
FIG. 6 is an enlarged cross-sectional view taken along the line VI—VI of FIG. 4.

FIG. 6 is an enlarged cross-sectional view taken along the line VI—VI of FIG. 4. As shown in this figure, the housing 57 is secured by two sets of bolts B1 and B2 to the cylinder block 33 so as to define, jointly with the cylinder block 33, the first cooling passage 51 and the drainage passage 54. The cover 58 is secured to the housing 57 by the bolt B1 and a set of bolts B3 so as to define, jointly with the housing 57, the bypass passage 53.

Figure 7:
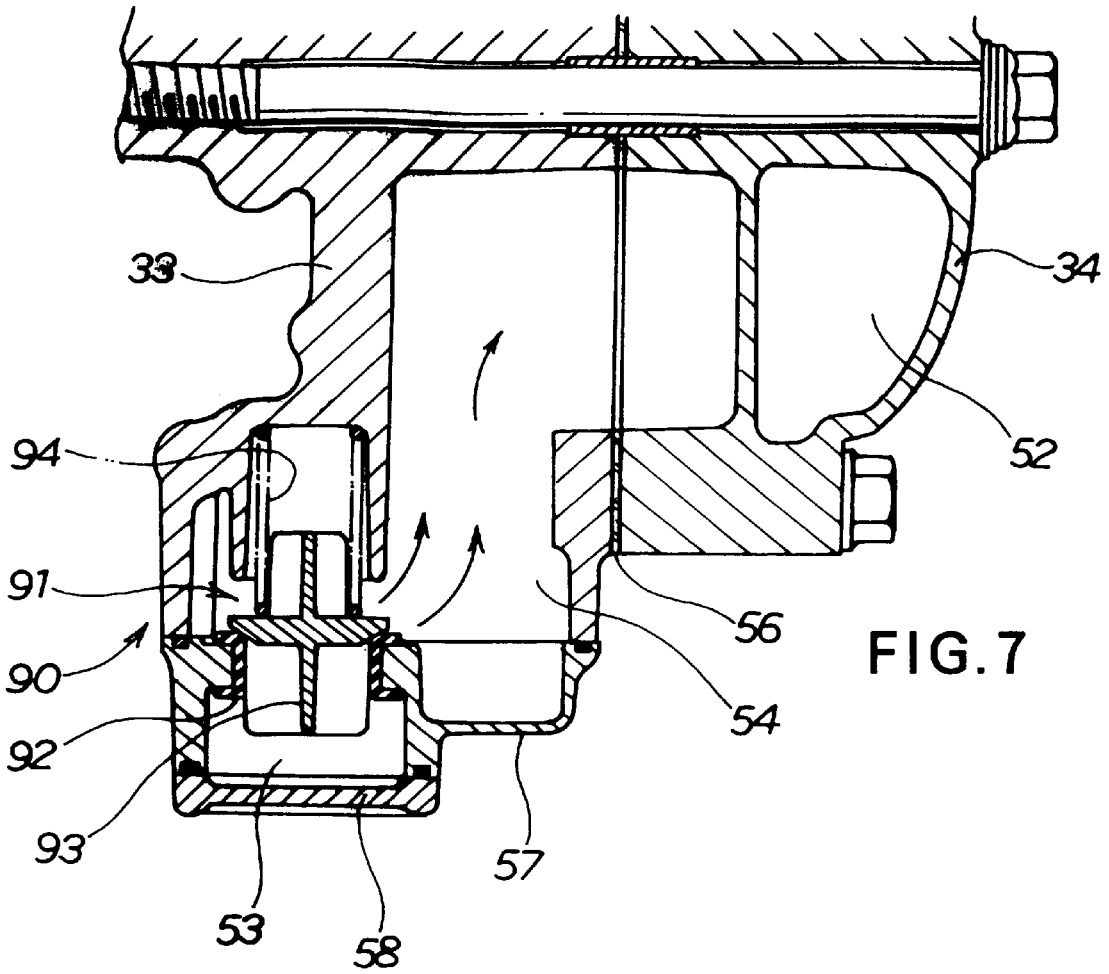
FIG. 7 is an enlarged cross-sectional view taken along the line VII—VII of FIG. 4, showing a relief valve.

FIG. 7 is an enlarged cross-sectional view taken along the line VII—VII of FIG. 4. As shown in this figure, the relief valve 90 is comprised of a valve chamber 91, a valve seat 92, a valve body 93 and valve spring 94. The valve chamber 91 is formed at a position or junction where the bypass passage 53 and the drainage passage 54 communicate with each other. The valve seat 92 is attached to the housing 57 at that portion of the bypass passage 53 which forms a part of the valve chamber 91. The valve seat 92 is made of rubber or synthetic resin so as to secure desired water-tightness between itself and the valve body 93 when the valve body 93 is seated against the valve seat 93. The valve body 93 has a cruciform section and is disposed in the valve chamber 91 such that a disk-like portion of the valve body 93 is movable into and away from sealing engagement with the valve seat 92. The valve spring 94 is a compression coil spring and acts between the cylinder block 33 and the valve body 93 to normally urge the valve body 93 in a direction to close the valve chamber 91. The relief valve 90 operates such that when the pressure of the cooling water coming from the bypass passage 53 exceeds a predetermined pressure, the valve body 93 separates from the valve seat 92 against the force of the valve spring 94 and thus interconnect the bypass passage 53 and the drainage passage 54 in fluid communication with each other. Thus, when the relief valve 90 is open, the cooling water flows from the bypass passage 53 to the drainage passage 54.

Figure 8:
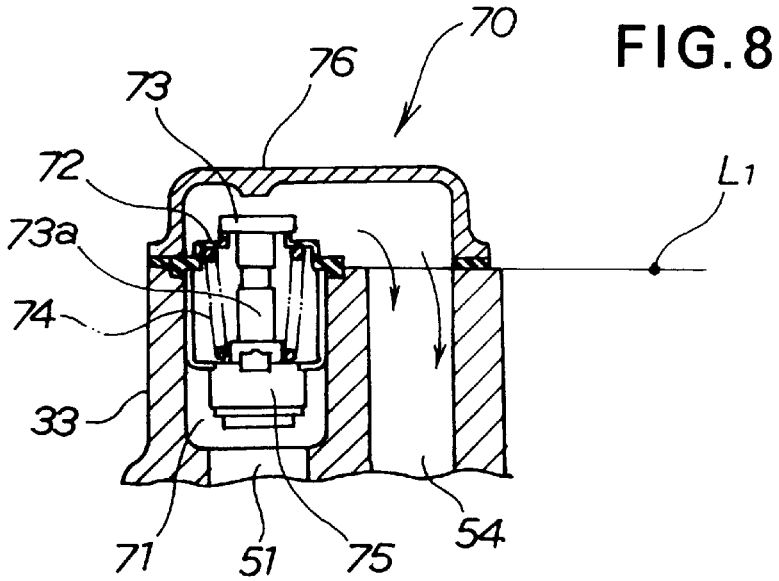
FIG. 8 is a cross-sectional view of a first thermostat.

FIG. 8 is a longitudinal cross-sectional view of the first thermostat 70. The first thermostat 70 is of the so-called "wax" type which operates using the temperature-dependent volumetric difference (expansion and contraction) of a paraffin wax pellet. The thermostat 70 is comprised of a valve chamber 71, a valve seat 72, a valve body 73, a valve spring 74 and a wax holding portion or container 75. The valve chamber 71 is defined in the cylinder block 33 and communicates with the first cooling passage 51. The valve seat 72 is made of rubber or synthetic resin so as to provide a hermetic seal between itself and the valve body 73 when the thermostat 70 is closed. The valve seat 72 is attached to an upper surface of the cylinder block 33. The valve body 73 is provided to close an opening in the valve seat 72 and connected to the inside of the wax container 75 via a piston rod 73*a*. The valve spring 74 is a compression coil spring normally urging the valve body 73 in a direction to close the opening in the valve seat 72. A cover 76 is attached to the upper surface of the cylinder block 33 via a gasket (not designated) disposed therebetween, so as to cover a junction between the valve chamber 71 and the drainage passage 54. In FIG. 8, reference character $L_1$ designates a thermostat level described later. The thermostat 70 operates such that when the temperature of the cooling water in the first cooling passage 51 is higher than a predetermined value, the wax pellet in the wax container 75 melts and expands, forcing the piston rod 73*a* out of the wax container 75 to thereby separate the valve body 73 from the valve seat 72 against the force of the compression spring 74. Thus, the first cooling passage 51 and the drainage passage 54 communicate with each other, and so the cooling water flows from the first cooling passage 51 to the drainage passage 54.

The second thermostat 80 shown in FIG. 3 has the same construction as the first thermostat 70 and further description thereof can, therefore, be omitted.

Figure 9:
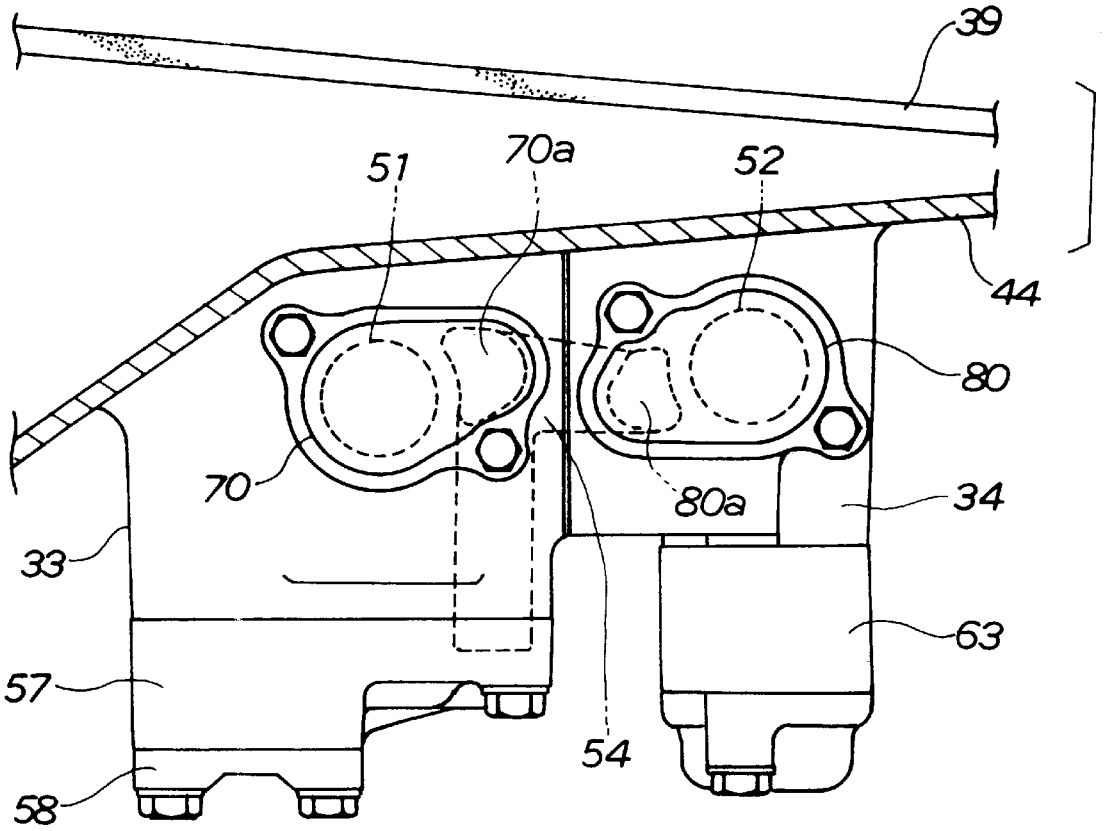
FIG. 9 is an enlarged plan view taken in the direction of the arrows substantially along the line IX—IX of FIG. 4.

FIG. 9 is an enlarged plan view taking in the direction of the arrows substantially along the line IX—IX of FIG. 4, the view showing the first thermostat 70 mounted on the upper surface of the cylinder block 33 and the second thermostat 80 mounted on the upper surface of the cylinder head 34.

As shown in FIG. 9, the first and second thermostats 70, 80 are disposed adjacent to each other, with their drainage portions (outlet sides) 70*a*, 80*a* disposed in confrontation with each other, so that these two thermostats 70, 80 use the same drainage passage 54 in common. The first and second thermostats 70, 80 mounted on the cylinder block 33 and the cylinder head 34, respectively, are arranged so as not to interfere with the first endless belt 39 and the belt cover 44.

Figure 10:
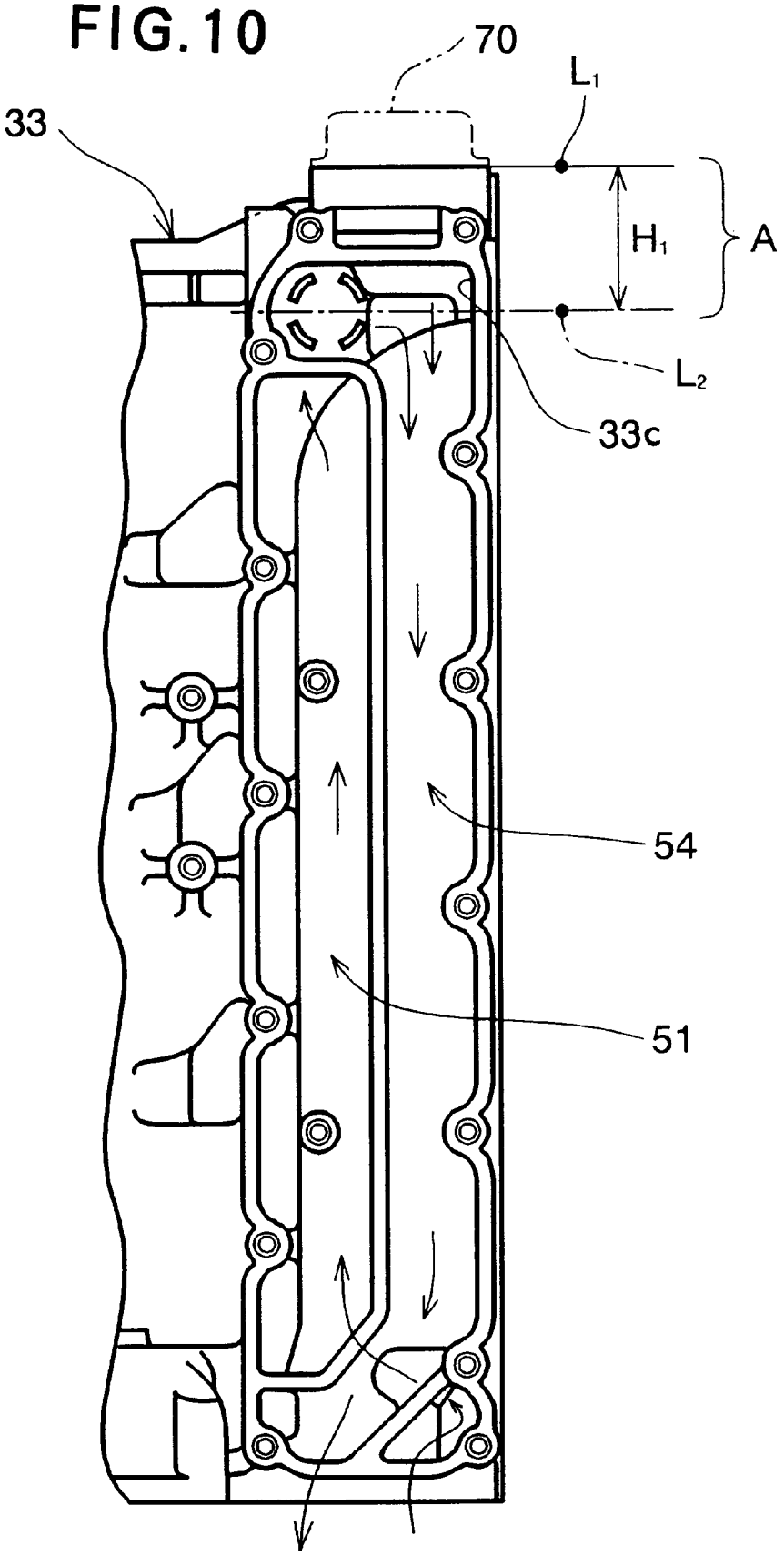
FIG. 10 is a side view of a cylinder block, showing the cooling water passage.

FIG. 10 is a side view of a portion of the cylinder block 33, showing a portion of the first cooling passage 51 and the drainage passage 54 that are formed in the side of the cylinder block 33.

The first thermostat 70 indicated by the phantom lines in FIG. 10 is disposed above the drainage passage 54 and, more particularly, it is mounted on the upper surface (hereinafter referred to as "thermostat level $L_1$") of the cylinder block 33. The relief valve 90 shown in FIG. 4 is disposed adjacent to an upper end of the drainage passage 54 and, more particularly, it is mounted on the upper portion (hereinafter referred to as "relief valve level $L_2$") of the side surface of the cylinder block 33 which is adjacent to the thermostat level $L_1$. The thermostat level $L_1$ and the relief valve level $L_2$ are vertically spaced from each other by a distance $H_1$. An upper end portion of the cylinder block 33 extending vertically between the thermostat level $L_1$ and the relief valve level $L_2$ is hereinafter referred to as "isolated portion A"

Operation of the engine cooling system of the foregoing construction for the outboard motor will be described below with reference to FIGS. 4 and 10.

Since the relief valve 90 is located at a position close to the first and second thermostats 70, 80, the distance $H_1$ between the first and second thermostats 70, 80 and the relief valve 90 is very small. Accordingly, in the case where a portion of the drainage passage 54 extending in the isolated portion A has no cooling water flowing therethrough, the cooling water pressure inside the bypass passage 53 rises to open the relief valve 90. When the relief valve 90 is open, the bypass passage 53 and the drainage passage 54 communicate with each other, allowing the cooling water to flow into the drainage passage 54. The cooling water thus flowing into the drainage passage 54 will cool substantially the entire area of the drainage passage 54 including a wall 33*c* of the isolated portion A. With this cooling, the drainage passage 54 has a uniform temperature distribution over the entire area thereof. Thus, there is no temperature difference developed between the cylinder block 33 and the cylinder head 34 particularly at a portion extending along mating surfaces of the cylinder block 33 and the cylinder head 34.

Figure 11:
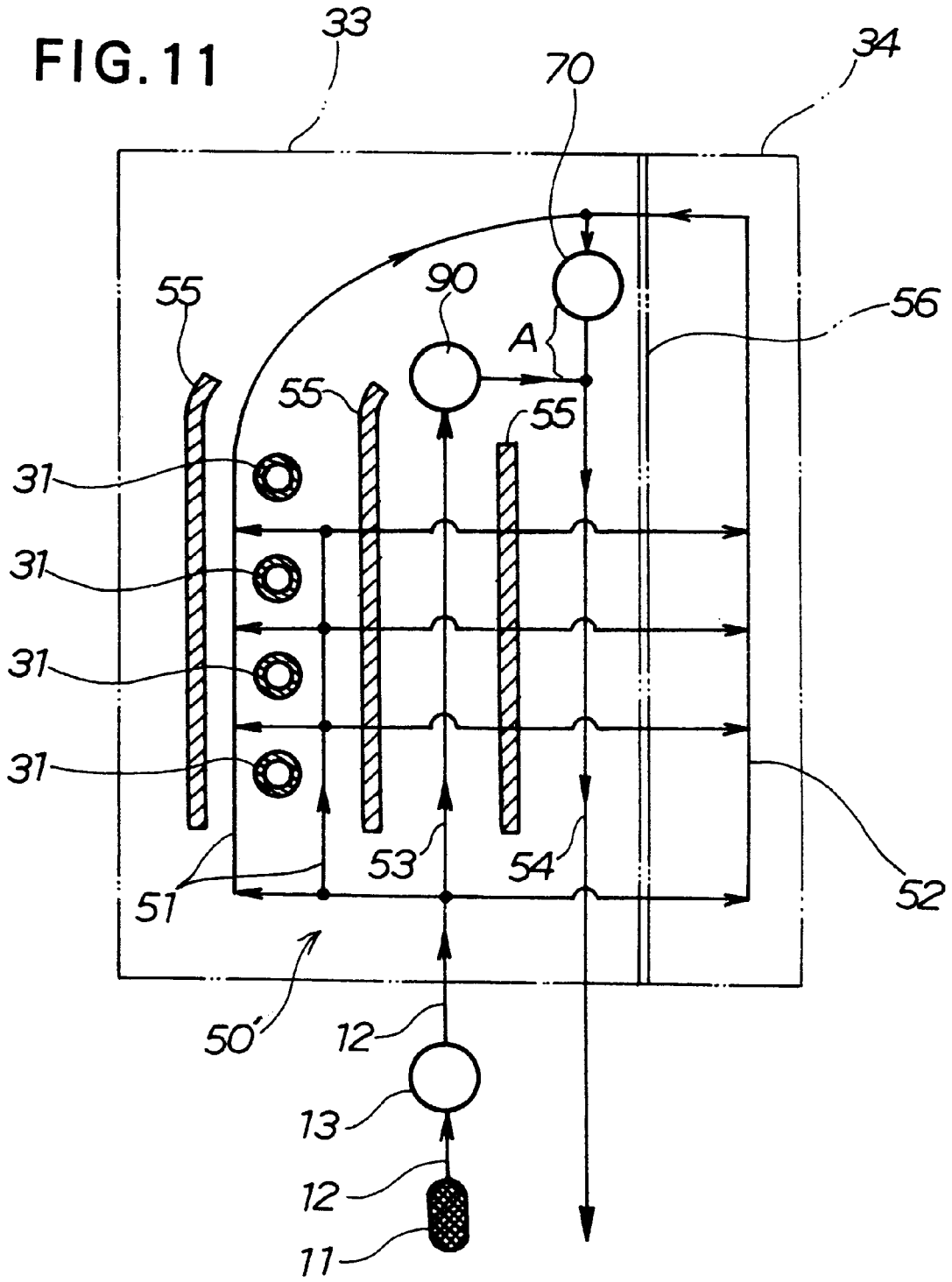
FIG. 11 is a diagrammatical view showing a modified form of the cooling water passage of the engine according to the present invention.

FIG. 11 diagrammatically shows a modified form of the cooling water passage of the vertical multicylinder engine according to the present invention. The modified cooling water passage 50' differs from the one 50 of the first embodiment shown in FIG. 3 in that the second thermostat 80 shown in FIG. 3 is omitted and a single thermostat 70 located at the same position as the first thermostat 70 of FIG. 3 serves also as the omitted second thermostat 80. The thermostat 70, when it is open, allows the cooling water to flow from the second cooling passage 52 into the drainage passage 54.

As described above, an engine cooling system of the present invention for use in an outboard motor preferably includes a cooling water passage 50 having incorporated therein a thermostat 70 mounted on the upper surface of a cylinder block 33 and a relief valve 90 mounted on an upper portion of one side surface of the cylinder block 33, the relief valve 90 being disposed adjacent to the thermostat 70. The thermostat 70 and the relief valve 90 may be attached either directly or indirectly to the cylinder block 33.

Obviously, various minor changes and modifications of the present invention are possible in the light of the above teaching. It is therefore to be understood that within the scope of the appended claims the invention may be practiced otherwise than as specifically described.

What is claimed is:

1. An engine cooling system for an outboard motor, comprising:

means defining a cooling water passage through which cooling water flows to cool an engine of the outboard motor;

a thermostat disposed across said cooling water passage to open and close said cooling water passage depending on the temperature of cooling water inside said cooling water passage; and a relief valve disposed across said cooling water passage to open and close said cooling water passage depending on the pressure of cooling water inside said cooling water passage, wherein said thermostat being mounted on a horizontal top surface of a cylinder block of said engine, and said relief valve being mounted on an upper portion of a vertical side wall of said cylinder block and located adjacent to said thermostat.

2. The engine cooling system according to claim 1, wherein said thermostat comprises a first thermostat disposed across a first cooling passage provided in said cylinder block and forming a part of said cooling water passage, and a second thermostat disposed across a second cooling passage provided in a cylinder head of said engine and forming another part of said cooling water passage.

3. The engine cooling system according to claim 2, wherein said cooling water passage comprises a common drainage passage communicating with said first and second cooling passages for allowing the cooling water flowing past said first and second thermostats to be drained off said engine.

4. The engine cooling system according to claim 3, wherein said cylinder block and said cylinder head have respective vertical contact surfaces at which said cylinder block and said cylinder head are mated together laterally, said cooling water passage further comprising a bypass passage extending vertically through said cylinder block between said first cooling passage and said contact surfaces, and said common drainage passage extending between said bypass passage and said contact surfaces along said contact surfaces.

5. The engine cooling system according to claim 1, wherein said thermostat comprises a single thermostat which opens and closes said cooling water passage depending on the temperature of cooling water inside a first cooling passage provided in said cylinder block and forming a part of said cooling water passage and the temperature of cooling water inside a second cooling passage provided in said cylinder head and forming another part of said cooling water passage.

6. The engine cooling system according to claim 5, wherein said cooling water passage comprises a common drainage passage communicating with said first and second cooling passages for allowing the cooling water flowing past said single thermostat to be drained of said engine.

7. The engine cooling system according to claim 6, wherein said cylinder block and said cylinder head have respective vertical contact surfaces at which said cylinder block and said cylinder head are mated together laterally, said cooling water passage further comprising a bypass passage extending vertically through said cylinder block between said first cooling passage and said contact surfaces, and said common drainage passage extending between said bypass passage and said contact surfaces along said contact surfaces.

8. An engine cooling system for an outboard motor, said outboard motor having a cylinder block and a cylinder head, said system comprising:

means defining a cooling water passage through which cooling water flows to cool an engine of the outboard motor;

a thermostat disposed across said cooling water passage to open and close said cooling water passage depending on the temperature of cooling water inside a first cooling passage provided in said cylinder block and forming a part of said cooling water passage and the temperature of cooling water inside a second cooling passage provided in said cylinder head and forming another part of said cooling water passage, said cooling water passage including a common drainage passage communicating with said first and second cooling passages for allowing the cooling water flowing past said thermostat to be drained of said engine, said cylinder block and said cylinder head having respective vertical contact surfaces at which said cylinder block and said cylinder head are mated together laterally, said cooling water passage further comprising a bypass passage extending vertically through said cylinder block between said first cooling passage and said contact surfaces, and said common drainage passage extending between said bypass passage and said contact surfaces along said contact surfaces; and a relief valve disposed across said cooling water passage to open and close said cooling water passage depending on the pressure of cooling water inside said cooling water passage.

* * * * *